US009506208B2

(12) United States Patent
Moorcroft

(10) Patent No.: US 9,506,208 B2
(45) Date of Patent: Nov. 29, 2016

(54) PET WASTE DISPOSAL APPARATUS

(71) Applicant: Brian Moorcroft, Waltham, MA (US)

(72) Inventor: Brian Moorcroft, Waltham, MA (US)

( * ) Notice: Subject to any disclaimer, the term of this patent is extended or adjusted under 35 U.S.C. 154(b) by 0 days.

(21) Appl. No.: 14/823,630

(22) Filed: Aug. 11, 2015

(65) Prior Publication Data

US 2016/0040378 A1 Feb. 11, 2016

Related U.S. Application Data

(60) Provisional application No. 62/035,559, filed on Aug. 11, 2014.

(51) Int. Cl.
*E01H 1/12* (2006.01)

(52) U.S. Cl.
CPC ..... *E01H 1/1206* (2013.01); *E01H 2001/1233* (2013.01); *E01H 2001/1293* (2013.01)

(58) Field of Classification Search
CPC ..... E01H 1/1206
USPC ..... 294/1.3, 1.4, 1.5, 50, 50.5, 61, 182; 56/400.21, 400.08
See application file for complete search history.

(56) References Cited

U.S. PATENT DOCUMENTS 2,020,571 A * 11/1935 Pick ..... A01B 1/243 111/92
2,500,647 A * 3/1950 Schulthess ..... E01H 1/12 294/50
3,265,429 A * 8/1966 Shatt ..... B25J 1/04 294/104
4,225,169 A * 9/1980 DeToma ..... B25J 1/04 294/1.4
4,232,422 A * 11/1980 Fellmann ..... A01B 1/222 16/427
4,286,816 A * 9/1981 Tobias ..... E01H 1/1206 294/1.4
4,289,344 A * 9/1981 Mitchell ..... A01D 7/00 172/372
4,422,681 A * 12/1983 Laroche ..... E01H 1/1206 294/1.4
5,037,235 A * 8/1991 Aquilina ..... B25G 1/04 16/427
5,370,433 A 12/1994 Yost
5,642,911 A * 7/1997 Gatch ..... E01H 1/12 294/50
6,260,896 B1 * 7/2001 Dozier ..... A47J 37/0786 294/219
6,634,163 B2 * 10/2003 Kill ..... A01D 51/00 56/400.03
6,942,264 B1 * 9/2005 Mendez ..... A01K 23/005 294/1.5
7,281,740 B1 * 10/2007 Fields ..... A01B 1/16 294/100
7,434,494 B1 * 10/2008 Snider ..... B25B 13/06 81/124.4

(Continued)

*Primary Examiner* — Paul T Chin
(74) *Attorney, Agent, or Firm* — Global Intellectual Property Agency, LLC; Daniel Boudwin

(57) ABSTRACT

A waste disposal apparatus having a handle, an elongated shaft, a base, and a disposable cartridge. The handle includes a cutout for manual gripping and a ring for attachment to a belt loop or other support. The cartridge provides a first side with a nub thereon and a second side with a plurality of tines disposed thereon and extending therefrom. The base provides a plate having a well with an open end and interior volume in which the nub of the cartridge engages therewith for removable securement. In operation, the user can place a bag over the base and push the nub into the open end of the well of the base for attachment thereto and impale animal waste using the tines. The user can then fold the bag over the cartridge and detach the bag from the plate enclosing the cartridge therein for disposal.

11 Claims, 3 Drawing Sheets

(56) References Cited

U.S. PATENT DOCUMENTS

| | | | | |
|---|---|---|---|---|
| 7,559,849 | B1 * | 7/2009 | Cuddie | A63B 53/14 172/378 |
| 7,784,257 | B2 * | 8/2010 | Williams | E01H 1/12 172/378 |
| 8,132,834 | B2 | 3/2012 | Buhagiar | |
| 9,033,385 | B2 * | 5/2015 | Sgroi, Jr. | E01H 1/12 294/182 |
| 2004/0124646 | A1 * | 7/2004 | Peko | A01K 23/005 294/1.4 |
| 2005/0082854 | A1 | 4/2005 | Barr | |
| 2007/0000227 | A1 * | 1/2007 | Mazar | A01D 7/00 56/400.01 |
| 2010/0192738 | A1 * | 8/2010 | Fenstemaker | B25F 1/00 81/489 |
| 2013/0234458 | A1 * | 9/2013 | Wilkins | A47G 25/902 294/3.6 |
| 2015/0093480 | A1 * | 4/2015 | Biever | A47J 43/16 426/281 |
| 2015/0257335 | A1 * | 9/2015 | Riggs | A01D 7/10 56/400.08 |

* cited by examiner

PET WASTE DISPOSAL APPARATUS

CROSS REFERENCE TO RELATED APPLICATION

This application claims the benefit of U.S. Provisional Application No. 62/035,559 filed on Aug. 11, 2014. The above identified patent application is herein incorporated by reference in its entirety to provide continuity of disclosure.

BACKGROUND OF THE INVENTION

Field of the Invention

The present invention relates to waste collection devices. More specifically, the present invention provides a pet waste disposal apparatus having an elongated shaft having a handle at a first end thereof and a base at a second end thereof, wherein a removable cartridge with a plurality of tines for impaling waste is removably securable to said base of said disposal apparatus. In this way, the cartridge can be disposed of after it has been used to collect pet waste thereon.

Cleaning pet waste can be an arduous and unsanitary task. Most pet owners often resort to carrying around small plastic bags in order to manually pick up and dispose of pet waste. This can be quite unsanitary and can cause feces and other debris to contact the hands or clothing of the pet owner. Some pet owners may use devices that can pick up pet waste in a shovel-like manner, however these devices need to be cleaned of pet waste after every use which can be undesirable and impractical. Further, it can be difficult to pick up pet waste using a scooping motion, preventing the pet owner from being able to clean up all of the pet waste. Thus, a device for allowing user to more easily collect pet waste without having to contact the pet waste with his or her hands is desired.

Description of the Prior Art

Devices have been disclosed in the prior art that relate to pet waste disposal apparatuses. These include devices that have been patented and published in patent application publications. These devices generally relate to pet waste disposal devices for scooping pet waste from the ground. These prior art devices have several known drawbacks. Some devices include claw-like structures for picking up pet waste and disposing of it thereafter. However, these devices are intended to be reused and can become quite dirty and unsanitary. Further, the claw-like portion requires daily cleaning and sanitizing as pet waste becomes stuck thereon. Other devices provide spike-like structures for impaling pet waste; however it becomes difficult to remove the pet waste from the spikes and requires manual removal of the pet waste from the spikes in order to later reuse the device.

Thus, there exists a need for a new and improved pet waste disposal apparatus having an elongated and adjustable handle and a base to which disposable cartridges with a plurality of tines can be removably attached. In light of the devices disclosed in the prior art, it is submitted that the present invention substantially diverges in design elements from the prior art and consequently it is clear that there is a need in the art for an improvement to existing pet waste disposal devices. In this regard the instant invention substantially fulfills these needs.

SUMMARY OF THE INVENTION

In view of the foregoing disadvantages inherent in the known types of pet waste disposal devices now present in the prior art, the present invention provides a new pet waste disposal apparatus, wherein the same can be utilized for providing convenience for the user when picking up and disposing of pet waste.

It is therefore an object of the present invention to provide a new and improved pet waste disposal device that has all of the advantages of the prior art and none of the disadvantages.

It is another object of the present invention to provide a pet waste disposal apparatus having an elongated telescopic shaft with a handle at a first end thereof.

Another object of the present invention is to provide a pet waste disposal apparatus having a removable cartridge with a plurality of tines extending therefrom.

Another object of the present invention is to provide a pet waste disposal apparatus wherein a removable cartridge is magnetically securable to the base of the elongated shaft.

Yet another object of the present invention is to provide a pet waste disposal apparatus having a base with a well thereon adapted to receive the nub of a removable cartridge.

Still yet another object of the present invention is to provide a new and improved pet waste disposal apparatus wherein the device may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
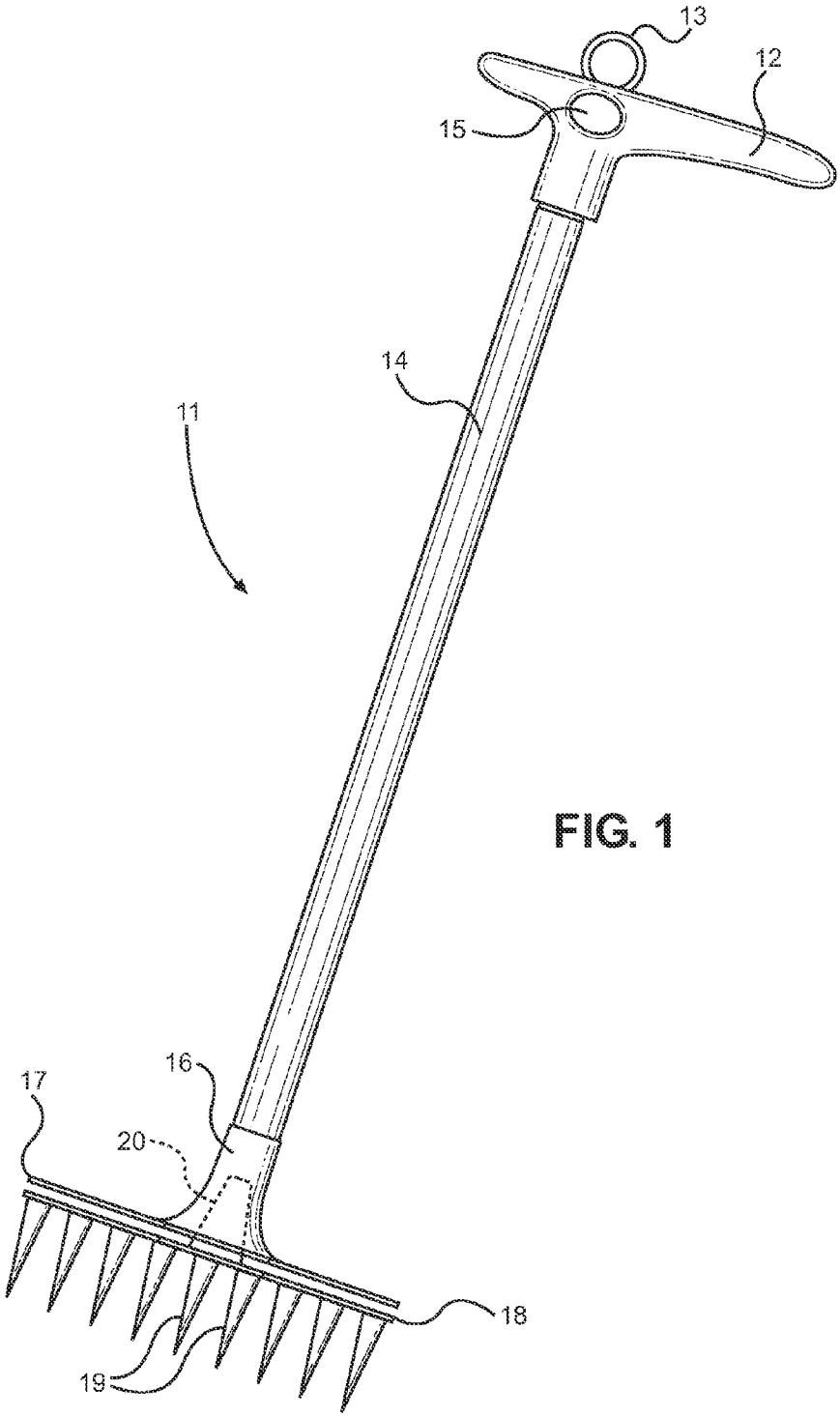
FIG. 1 shows a front view of the pet waste disposal apparatus.

Reference is made herein to the attached drawings. Like reference numerals are used throughout the drawings to depict like or similar elements of the pet waste disposal apparatus. For the purposes of presenting a brief and clear description of the present invention, the preferred embodiment will be discussed as used for picking up and disposing of waste. The figures are intended for representative purposes only and should not be considered to be limiting in any respect.

Referring now to FIG. 1, there is shown a front view of the pet waste disposal apparatus. The pet waste disposal apparatus 11 comprises an elongated shaft 14 having a first end and a second end. The elongated shaft 14 is shown as having a cylindrical configuration, however, in other embodiments, the shaft 14 can have alternate shapes. Further, the elongated shaft 14 is preferably composed of a durable and lightweight material.

The first end of the elongated shaft 14 comprises a handle 12 thereon for the user to grasp in order to manipulate and control the pet waste disposal apparatus 11. In the illustrated embodiment, the handle 12 comprises an oblong shape such that it is conducive for comfort and grasping by the user. The handle 12 further comprises a circular cutout 15 through which the user can insert one or more fingers in order to adequately grip the handle 12 of the device. A ring 13 is disposed on and is integral with the handle 12 of the pet waste disposal apparatus 11 in order to enable the user to attach miscellaneous items for storage thereof. Further, the ring 13 can be clipped to the user's belt or other support for easy carrying of the pet waste disposal device.

The second end of the elongated shaft 14 comprises a base 16, wherein the base 16 includes a plate 17, wherein the plate 17 is substantially planar in structure and is rectangular shaped in a preferred embodiment. The base 16 further provides a well on a central portion of the plate 17 having an open end and an interior volume, wherein the open end is flush with the second side of the plate 17.

A cartridge 18 is removably securable to the base 16 of the pet waste disposal apparatus 11. The cartridge 18 comprises a first side having a nub 20 thereon and a second side having a plurality of tines 19 extending therefrom. The nub 20 can be inserted into the well of the base 16 in order to secure the cartridge 18 to the base 16. In some embodiments, the well includes a magnetic material adapted to magnetically engage with the nub 20 of the cartridge 18. Thus, the nub 20 is composed of a metallic or magnetic material so as to be able to magnetically engage with the well of the base 16. In other embodiments, the well comprises one or more teeth 25 therein, as shown in FIG. 2, wherein the teeth 25 help to secure the nub 20 within the well.

Figure 2:
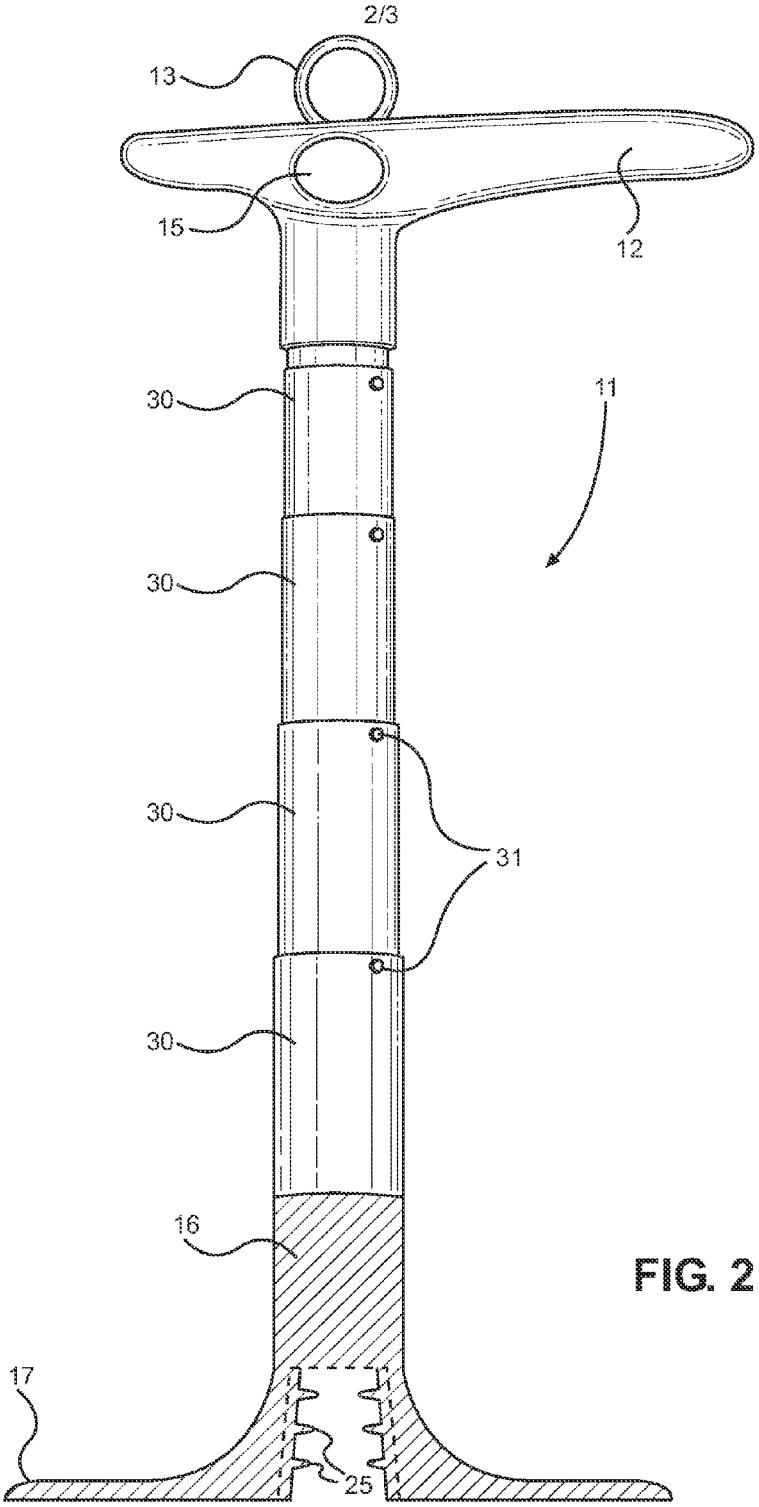
FIG. 2 shows a view of an embodiment of the pet waste disposal apparatus having a telescopic shaft.

Referring now to FIG. 2, there is shown a view of an embodiment of the pet waste disposal apparatus having a telescopic shaft. In the illustrated embodiment, the elongated shaft 14 is telescopic so that the length of the shaft can be increased or decreased as desired by the user. The elongated shaft 14 comprises a plurality of tubular sections 30 having a decreasing cross sectional area, wherein the sections can be collapsed into one another or can be extended from one another so as to adjust the length thereof.

Each section 30 includes a locking mechanism 31 for maintaining the elongated shaft at a desired length. In the illustrated embodiment, the locking mechanism 31 comprises one or more holes that engage with protuberances. At least one of the plurality of sections 30 provides at least one hole and one protuberance disposed thereon, wherein the protuberance of a smaller sized section can engage with the hole of a larger sized section and becomes affixed therein as to lock the elongated shaft to a desired size for the user. In use, the user can manually grasp each section and adjust it to a desired length via the locking mechanism 31.

Figure 3:
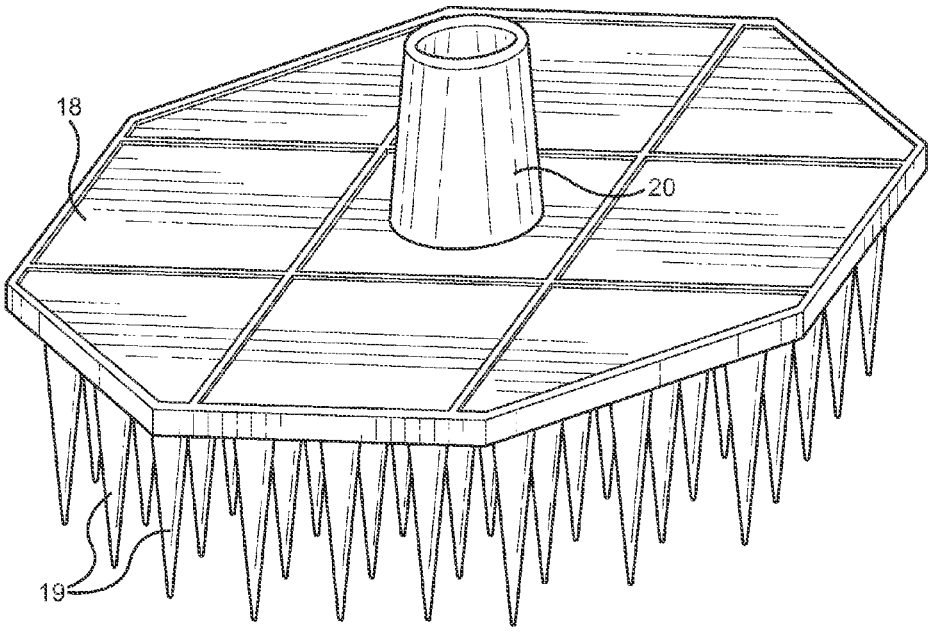
FIG. 3 shows a close-up view of the cartridge of the pet waste disposal device.

Referring now to FIG. 3, there is shown an overhead view of the cartridge of the pet waste disposal apparatus. The pet waste disposal apparatus comprises a removable cartridge 18. In the illustrated embodiment, the cartridge 18 comprises an octagonal shape, however, in alternate embodiments, the cartridge 18 comprises any of various other shapes or geometries. The cartridge 18 comprises a first side and a second side, wherein the first side provides a nub 20. The nub 20 comprises a cylindrical shape. The nub is constructed so as to fit within the interior volume of the well for removable securement thereto. When the cartridge 18 is secured to the base, the first side becomes substantially flush with the plate of the base.

The second side of the cartridge 18 comprises a plurality of tines 19 disposed thereon. The tines 19 extend substantially perpendicularly from the cartridge 18 and are intended to impale pet waste. The tines 19 are shown as having a conical shape, however, in alternate embodiments the tines 19 can resemble sharp pins or may have a triangular shape. The tines 19 are preferably evenly spaced on the cartridge 18. The tines 19 are preferably substantially the same shape and size so that the tines 19 can uniformly collect pet waste. The tines 19 may be arranged in a grid pattern on the cartridge 18 so that the tines 19 are uniformly distributed on the cartridge 18.

In operation, the user can place a disposable plastic bag over the base of the pet waste disposal apparatus. The bag which can be used is a standard plastic bag having a top and a bottom, an open end, a unitary wall and an interior volume. When the bag is placed over the base of the pet waste disposal apparatus, the base and portion of the shaft of the device is located within the interior volume of the bag, wherein the base of the device rests against the interior volume at bottom of the bag. The open end of the bag is then located nearer the first end of the shaft of the device.

The user can grasp the handle of the device and manually align the open end of the well of the base with the nub 20 of the cartridge 18 and press the well of the device over the open end of the nub 20, wherein the teeth of the well contacts the first side of the nub 20 causing friction and securing the nub 20 within the interior volume of the well. As such, the plastic bag remains over the base and also within the interior volume of the well as it becomes pushed within the interior volume of the well upon pushing the nub 20 within the interior volume of the well and is this removably contained and secured therein.

When assembled as described above, the user can then impale the pet waste via pushing the tines of the cartridge 18 onto the pet waste, wherein the pet waste thus contacts the second side of the cartridge 18 and remains impaled and adhered to the tines 19 of the cartridge 18. The user can then fold the disposable bag over the cartridge 18 such that the interior volume of the bag encloses the cartridge 18 and the pet waste therein. The user can proceed to grasp the open end of the bag and pull the bag away from the plate of the base thus detaching and removing the nub 20 of the cartridge 18 from the well of the base. Consequently, the pet waste and the cartridge are contained in the bag and the user can tie a knot in order to seal the open end of the bag to which the user can then dispose of the pet waste and cartridge 18 in a sanitary manner.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pet waste disposal apparatus, comprising:

an elongated telescopic shaft having a first end and a second end, wherein the telescopic shaft comprises a plurality of tubular sections disposed along its linear length that are extendable from one another;

said first end comprising a handle having a cut-out portion and a ring integrally affixed to an upper end thereof;

said second end comprising a base, said base having a plate;

a removable cartridge with a plurality of tines extending therefrom, wherein said removable cartridge is removably securable to said base;

wherein said base comprises a well and wherein said cartridge comprises a nub having a magnetic material adapted to be removably engaged with said well so as to secure said cartridge to said base.

2. The pet waste disposal apparatus of claim 1, wherein said handle is oblong in shape and the cutout is circular in shape.

3. The pet waste disposal apparatus of claim 1, wherein said well comprises one or more teeth therein for securing said nub of said cartridge therein.

4. The pet waste disposal apparatus of claim 1, wherein said well comprises a magnetic material so as to magnetically engage with said nub of said cartridge.

5. The pet waste disposal apparatus of claim 1, wherein the plurality of tubular sections have decreasing cross-sectional areas.

6. The pet waste disposal apparatus of claim 5, wherein each of the plurality of tubular sections comprise:

at least one hole disposed thereon; and at least one protuberance disposed thereon;

wherein a protuberance of a tubular section having a smaller cross-sectional area is configured to engage with a hole of a tubular section having a larger cross-sectional area, thereby enabling the length of the telescopic shaft to be adjustable.

7. A pet waste disposal apparatus, comprising:

an elongated telescopic shaft having a first end and a second end, wherein the telescopic shaft comprises a plurality of tubular sections disposed along its linear length that are extendable from one another;

an oblong-shaped handle disposed on the first end of the telescopic shaft;

a circular cut-out portion disposed on the handle;

a ring integrally affixed to an upper end of the handle;

a base disposed on the second end of the telescopic shaft, the base comprising a plate having a well centrally disposed thereon;

a removable cartridge having a first side and a second side; wherein the first side comprises a nub extending upwardly therefrom and the second side comprises a plurality of tines extending downwardly therefrom;

wherein the nub is configured to removably engage with the well of the base so as to removably secure the cartridge to the base.

8. The pet waste disposal apparatus of claim 7, wherein the nub of the cartridge and the well of the base each comprise a magnetic material configured to removably engage with one another.

9. The pet waste disposal apparatus of claim 7, wherein said well comprises one or more teeth therein for securing said nub of said cartridge therein.

10. The pet waste disposal apparatus of claim 7, wherein the plurality of tubular sections have decreasing cross-sectional areas.

11. The pet waste disposal apparatus of claim 7, wherein each of the plurality of tubular sections comprise:

at least one hole disposed thereon; and at least one protuberance disposed thereon;

wherein a protuberance of a tubular section having a smaller cross-sectional area is configured to engage with a hole of a tubular section having a larger cross-sectional area, thereby enabling the length of the telescopic shaft to be adjustable.

* * * * *